US005325589A

United States Patent [19]

Kubo

[11] Patent Number: 5,325,589

[45] Date of Patent: Jul. 5, 1994

[54] HAIR CLIPPER

[75] Inventor: Nobuhiro Kubo, Hikone, Japan

[73] Assignee: Matsushita Electric Works, Ltd., Osaka, Japan

[21] Appl. No.: 712,097

[22] Filed: Jun. 7, 1991

[30] Foreign Application Priority Data

Jun. 15, 1990 [JP] Japan ..... 2-158043
Aug. 28, 1990 [JP] Japan ..... 2-227332

[51] Int. Cl.[5] ..... B26B 19/00

[52] U.S. Cl. ..... 30/201; 30/195; 30/196

[58] Field of Search ..... 30/201, 202, 195, 196

[56] References Cited

U.S. PATENT DOCUMENTS

| | | | |
|---|---|---|---|
| 2,470,287 | 5/1949 | Carter | 30/195 |
| 4,557,050 | 12/1985 | Haraguchi et al. | 30/195 |
| 4,581,822 | 4/1986 | Fujimura | 30/201 |
| 4,669,189 | 6/1987 | Ullmann | 30/196 |
| 4,776,095 | 10/1988 | Tsujimoto et al. | 30/201 |
| 4,825,546 | 5/1989 | Araki et al. | 30/195 |
| 4,949,460 | 8/1990 | Sterk | 30/201 |

FOREIGN PATENT DOCUMENTS

| | | | |
|---|---|---|---|
| 3310706 | 9/1984 | Fed. Rep. of Germany | 30/201 |

*Primary Examiner*—Richard K. Seidel
*Assistant Examiner*—Hwei-Siu Payer
*Attorney, Agent, or Firm*—Stevens, Davis, Miller & Mosher

[57] ABSTRACT

A hair clipper has a cutter head on the front end of a housing. The cutter head includes a toothed stationary blade and a toothed movable blade reciprocating on the stationary blade in hair shearing engagement between individual toothed edges thereof. The toothed edge of the stationary blade is tapered to have a thickness narrower toward its leading edge along an edgewise direction thereof. The stationary blade is slidable in a direction perpendicular to the reciprocating direction thereof, for varying a cut length of the hairs to be sheared between the movable and stationary blades. An adjustor handle is slidably mounted on the housing and linked to the movable blade for effecting the sliding movement thereof. A latch is provided to latch the adjustor handle in position for fixing the cut length. A release knob projects on a portion of the handle to be accessible by a finger of the user manipulating the handle. The release knob is actuated upon being pressed to unlatch the latch means for permitting the slidable movement of the adjustor handle and the movable blade in the direction of adjusting the cut length.

5 Claims, 16 Drawing Sheets

HAIR CLIPPER

BACKGROUND OF THE INVENTION

1. Field of the Invention

The present invention is directed to a hair clipper, and more particularly to a powered hair clipper capable of varying a cut length of the hairs especially suitable for cutting the hairline at the nape.

2. Description of the Prior Art

Hair clippers with varying cut length capability have been known as disclosed in U.S. Pat. No. 2,726,447 in which one of cutter blades is driven by a motor to move back and forth in the edgewise direction while it is driven to reciprocate transversely for hair shearing between toothed edges of the cutter blades. Since the one of the cutter blades is driven by the motor to shift its position relative to the other cutter blade in synchronism with the hair shearing reciprocating movement of that blade, the cut length will be continuously varied during the hair shearing operation without causing any unexpected shifting of the one cutter blade relative to the other cutter blade which would otherwise result in uneven hair cutting. Nevertheless, it is sometimes required for more convenient hair cutting to adjust the cut length or depth manually and independently of the hair shearing reciprocating movement. To satisfy this requirement, it is contemplated to provide an adjustor handle on a hair clipper housing to be readily accessible by the hand of the user for varying the cut length. However, there is a certain limitation in this structure that the one cutter blade should have sufficient frictional engagement with the other cutter blade in order to avoid unexpected shifting of the one blade relative to the other blade. The result is that a relatively great operational force is required for the user to slide the handle and therefore the cutter blade against the frictional force when adjusting the cut length of the hairs. This is inconvenient and is therefore a cause of accumulating fatigue of the wrist and of the fingers when shearing the hairs while varying the cut length continuously and manually, for example, in cutting the hairline at the nape where the cut length is gradually varied without leaving any noticeable steps therein. Such fatigue will mount rapidly especially when cutting the hairs of plural persons successively, which eventually results in an undesired uneven cut.

SUMMARY OF THE INVENTION

The above problem and insufficiency have been eliminated in an improved hair clipper of the present invention. The hair clipper in accordance with the present invention has a cutter head at the front end of a housing. The cuter head comprises a toothed stationary blade and a toothed movable blade reciprocating on the stationary blade in hair shearing engagement between individual toothed edges thereof. The toothed edge of the stationary blade is tapered to have a thickness narrower toward its leading edge along an edgewise direction to define on the surface opposite of the movable blade an skin engaging surface inclined with respect to a cutting plate defined between the stationary and movable blades. One of the stationary and movable blades is slidable in an edgewise direction perpendicular to the reciprocating direction of the movable blade to make a toothed edge thereof shiftable relative to the narrowing toothed edge of the stationary blade for varying a cut length of the hairs to be sheared between the toothed edges of the stationary and movable blades. The housing is provided with an adjustor handle which is linked to the slidable one of the stationary and movable blades for shifting it in the edgewise direction. A latch means is included to latch the adjustor handle at a desired position for fixing the cut length. A release knob projects on a portion of the handle to be accessible by a finger of the user manipulating the handle. The release knob is provided to unlatch the adjustor handle upon being pressed to thereby permit the slidable movement of the handle for adjusting the cut length. By the provision of the latch means with the release knob, it is readily possible to keep the handle at any desired position for shearing the hair to a desired cut length, yet allowing the handle to move only with a slight manipulation force.

Accordingly, it is a primary object of the present invention to provide an improved hair clipper which is capable of facilitating to cut the hair to any desired cut length without causing uneven hair cuts with a minimum manipulation force of adjusting the cut length.

The latch means comprises a rack formed on the housing and a toothed member on the part of the handle which are in meshing engagement with each other in such a manner as to provide a greater latching force when moving the handle in a direction of increasing the cut length than moving said handle in the opposite direction of reducing said cut length. With this arrangement, the operator can receive more resistance when moving the handle in a direction of increasing the cut length and be therefore well confirmed of the effect, thereby preventing unintentional excess cut. This is most advantageous in the cutting operation of starting the cut at a hairline of the nape and advancing upwardly toward the top of the head by gradually decreasing the cut length because of that the operator can be well prevented from accidentally increasing the cut length.

It is therefore another object of the present invention to provide an improved hair clipper which is capable of warning the operator when increasing the cut length and therefore well preventing an unintentionally excess hair cut.

Preferably, the handle is slidable on the housing in the same direction of the slidable one of the stationary and movable blade with its forward movement corresponding to the direction of decreasing said cut length. Therefore, when advancing the hair cutter from the hairline at the nape upwardly toward the top of the head with decreasing cut length for effecting tapered cut on the back of the head, the operator is required only to intuitively push the handle forward for decreasing the cut length in coincidence with the upwardly advancing movement of the hair clipper.

It is therefore a further object of the present invention to provide an improved hair clipper which can be intuitively manipulated in effecting the tapered cut on the back of the head.

The hair clipper may be provided with a comb attachment for smoothing the hairs into shearing between the stationary and movable blades as well as for spacing the cutter edge further away from the scalp to adjust the cut length.

These and still other objects and advantageous features of the present invention will become more apparent from the following description of the preferred embodiment when taken in conjunction with the attached drawings.

BRIEF DESCRIPTION OF THE DRAWINGS

FIGS. 23 to 25 are partial views of the rear end portion of a modified clipper housing; and.

DETAILED DESCRIPTION OF THE PREFERRED EMBODIMENT

Figure 1:
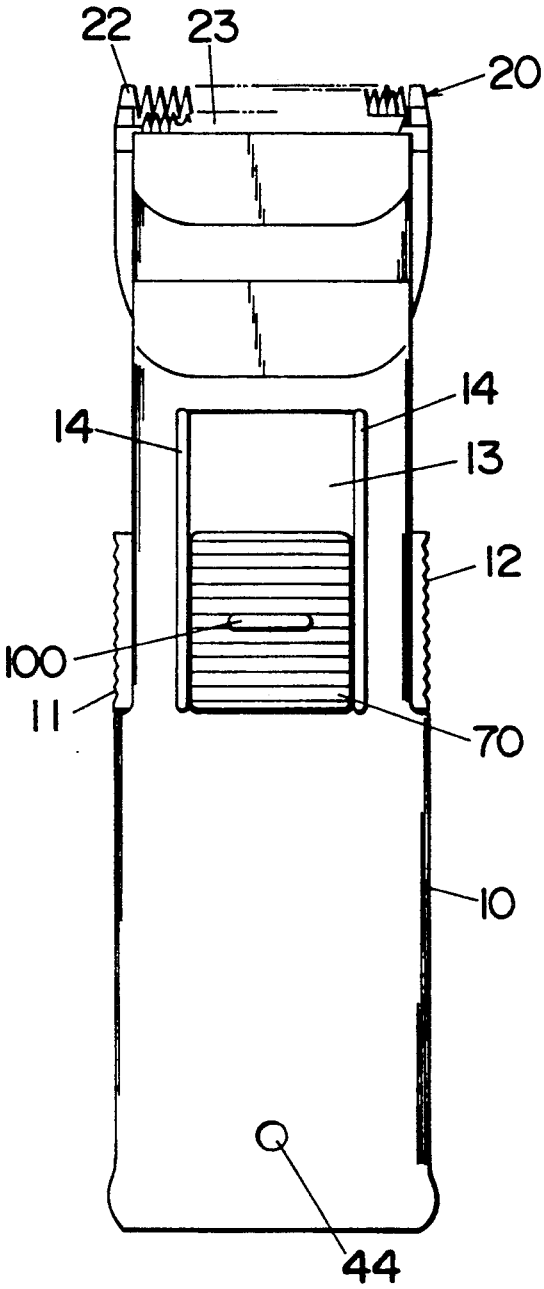
FIG. 1 is a top view of a hair clipper in accordance with a preferred embodiment of the present invention.
Figure 2:
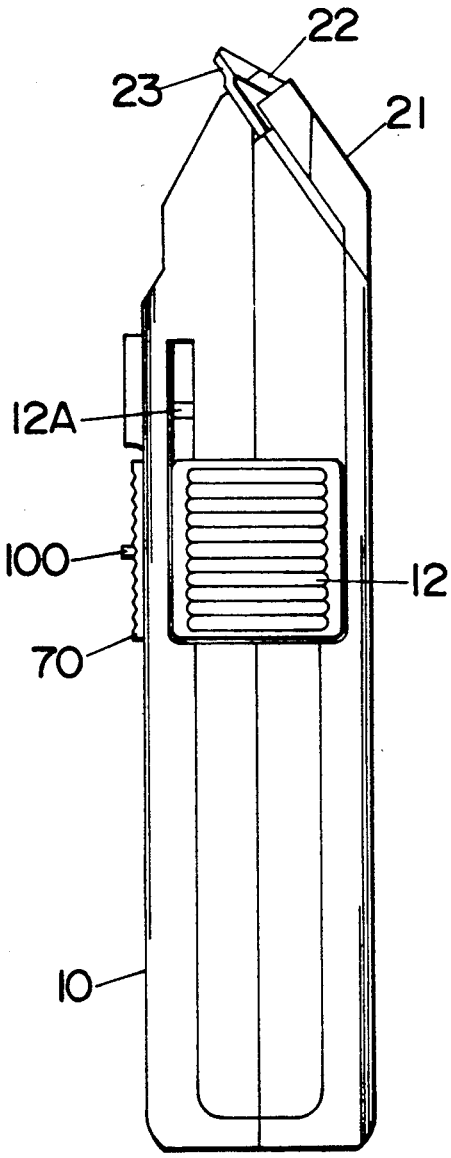
FIG. 2 is a side view of the hair clipper.
Figure 3:
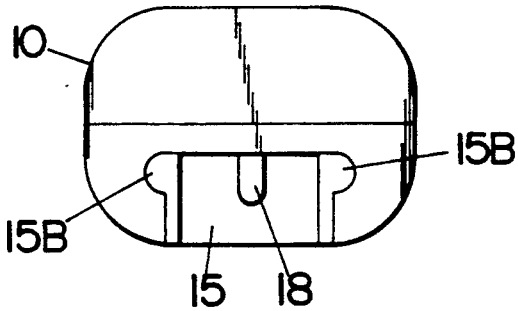
FIG. 3 is a rear view of the hair clipper.
Figure 4:
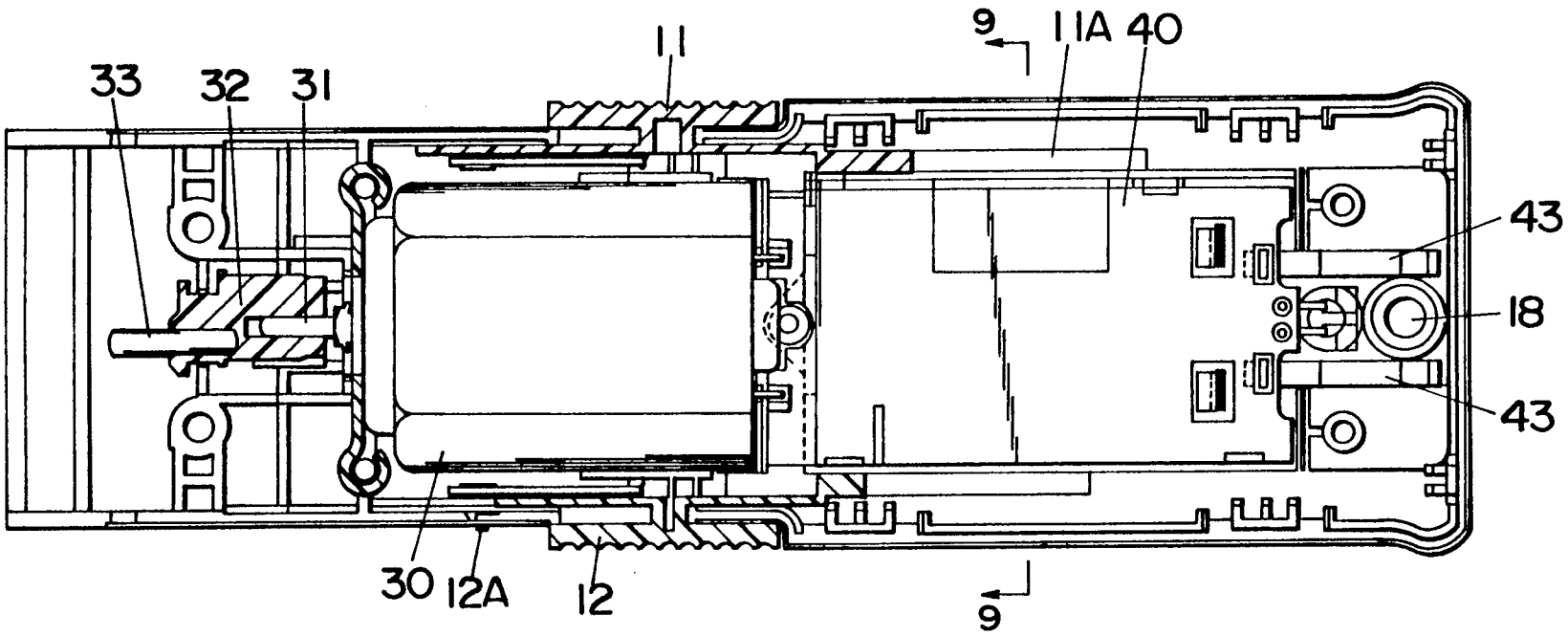
FIG. 4 is a bottom view of an upper half of a clipper housing with a cutter head removed therefrom.
Figure 5:
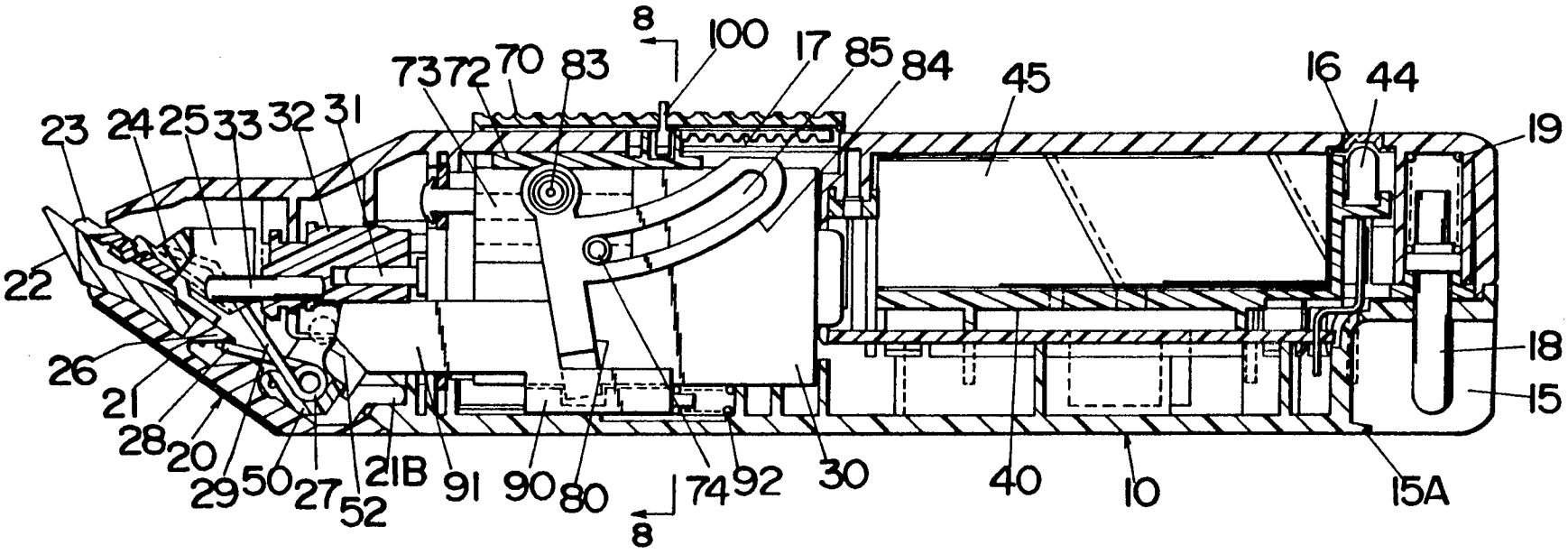
FIG. 5 is a vertical section of the hair clipper with a movable blade and an adjustor handle shown in a retracted position.

Referring now to FIGS. 1 to 3, there is shown a hair clipper in accordance with a preferred embodiment of the present invention. The clipper comprises an elongated tubular grip housing 10 carrying a cutter head 20 at its front end. The cutter head 20 comprises a base plate 21 carrying a stationary blade 22 and a movable blade 23 which define therebetween a cutting plane inclined with respect to a longitudinal axis of the housing 10. As shown in FIG. 5, the stationary blade 22 has a toothed edge which is tapered to define on its lower surface a skin engaging surface inclined with respect to the cutting plane for facing engagement with the scalp of the head. The movable blade 23 is supported on a drive element 24 which is slidable along the toothed edge of the stationary blade 22 for shearing engagement between toothed edges of the stationary and movable blades 22 and 23 and also slidable in an edgewise direction while keeping the shearing engagement.

Figure 9:
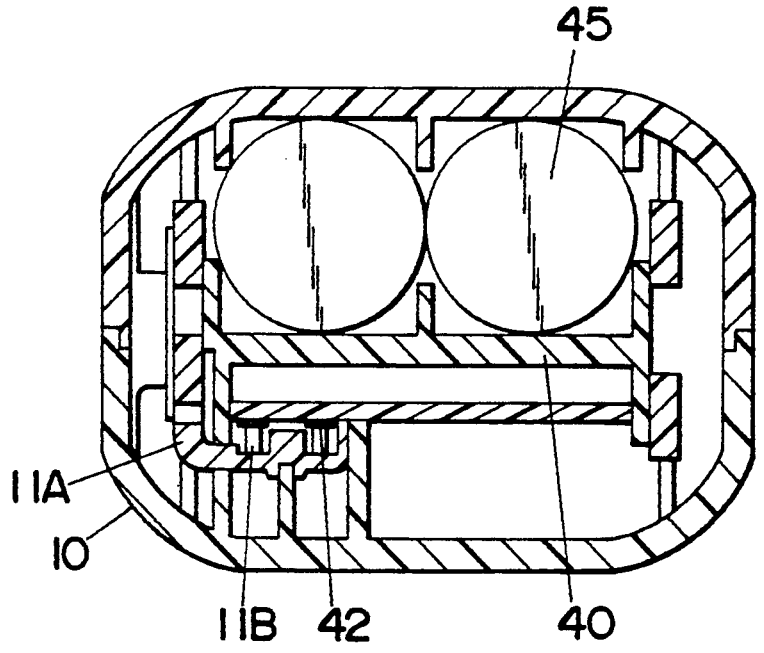
FIG. 9 is a sectional view taken along line 9—9 of FIG. 4.
Figure 11:
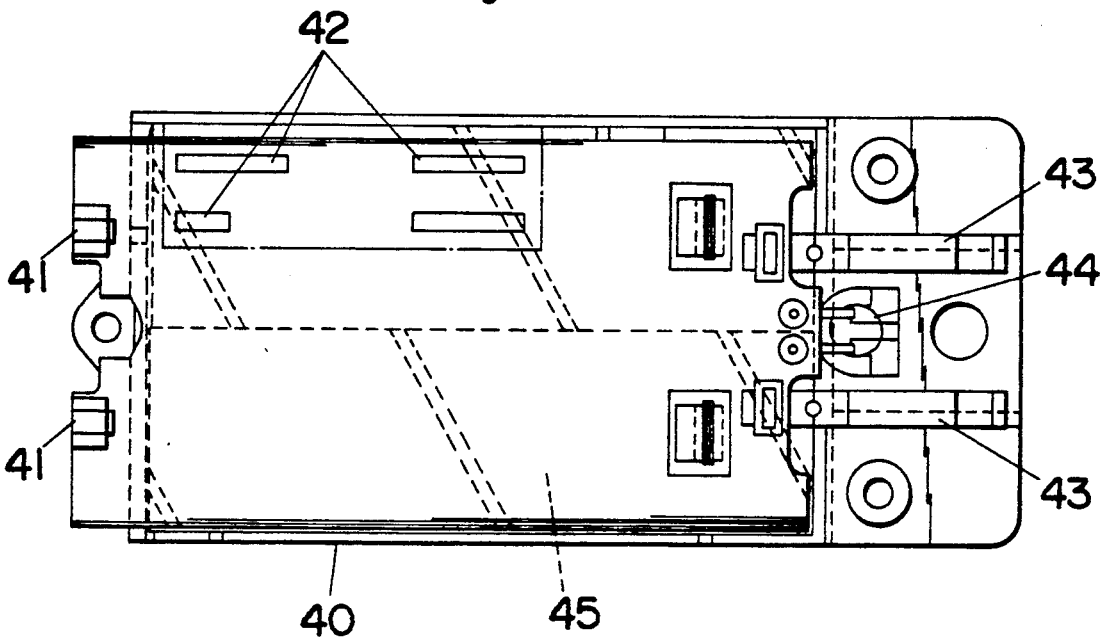
FIG. 11 is a bottom view of a battery holder accommodated in a clipper housing.
Figure 12:
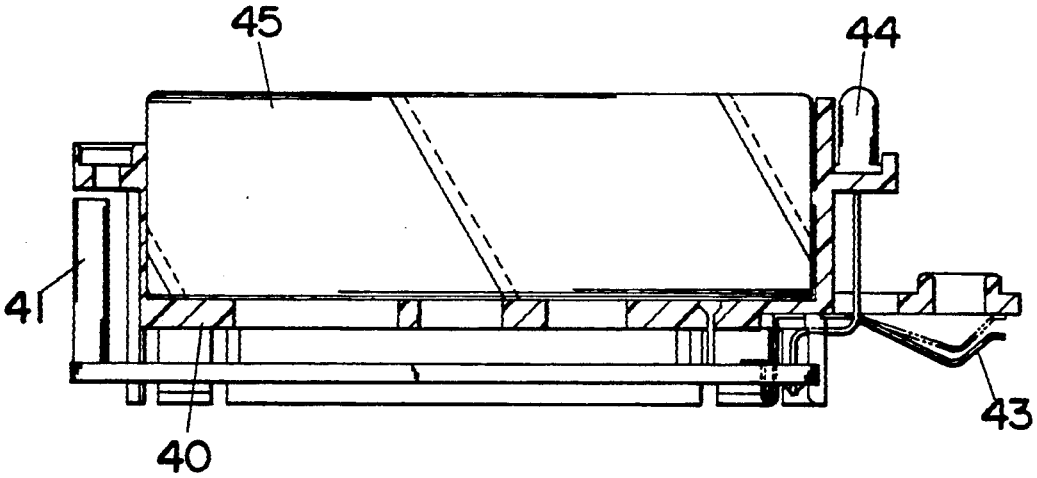
FIG. 12 is a vertical section of the battery holder.

A motor 30 is incorporated within housing 10 behind the cutter head 20 to have its output shaft 31 connected to a rotary cam 32 with an eccentric pin 33. The eccentric pin 33 extends into a cam slot 25 so as to translate the rotary motion of the eccentric pin 33 into a reciprocatory motion of the drive element 24 and the movable blade 23 in a direction transverse to the axis of the pin 33. Thus, the movable blade 23 is driven by the motor 30 to reciprocate on the stationary blade 22 for shearing the hairs therebetween. Disposed in the rear half of the housing 10 is a battery holder 40 which mounts on its upper surface rechargeable batteries 45 and mounts on its lower surface electronic components forming motor driving and battery charging circuits. As shown in FIGS. 11 and 12, the battery holder 40 has a pair of contact springs 41 for electrical connection with corresponding feed lugs on the rear end of the motor 30. The holder 40 has a set of conductors 42 forming an electrical switch in cooperation with a corresponding switch contact 11B for connecting and disconnecting the motor 30 to and from the batteries 45 in response to the sliding movement of a switch handle 11 on one side of the housing 10. The switch handle 11 has an extension 11A extending rearwardly within the housing 10 and carrying a switch contact 11B for contact with the conductors 42. As shown in FIG. 9, a space in which the switch contact 11B is in contact with the conductor 42 is surrounded by internal ribs of the housing 10 so as to be protected from the entry of the clipped hairs. Extending on the rear end of the battery holder 40 is a pair of terminal springs 43 which are exposed into a socket 15 formed in the rear lower end of the housing 10 for electrical connection with a plug 60 at one end of a power cord, the detail of which will be discussed hereinafter. An on-charge lamp 44 is mounted at the rear end of the holder 40 to be seen through a window 16 in the upper rear end of the housing The battery holder 40 thus mounting the batteries 45 and the associated electrical parts can be assembled into the housing 10 as one unitary structure. The housing 10 is also provided on its side opposite of the switch handle 11 with a comb handle 12 which is slidable along the length of the housing 10 to correspondingly move a comb attachment fitted over the cutter head 20, as will be discussed later.

Figure 6:
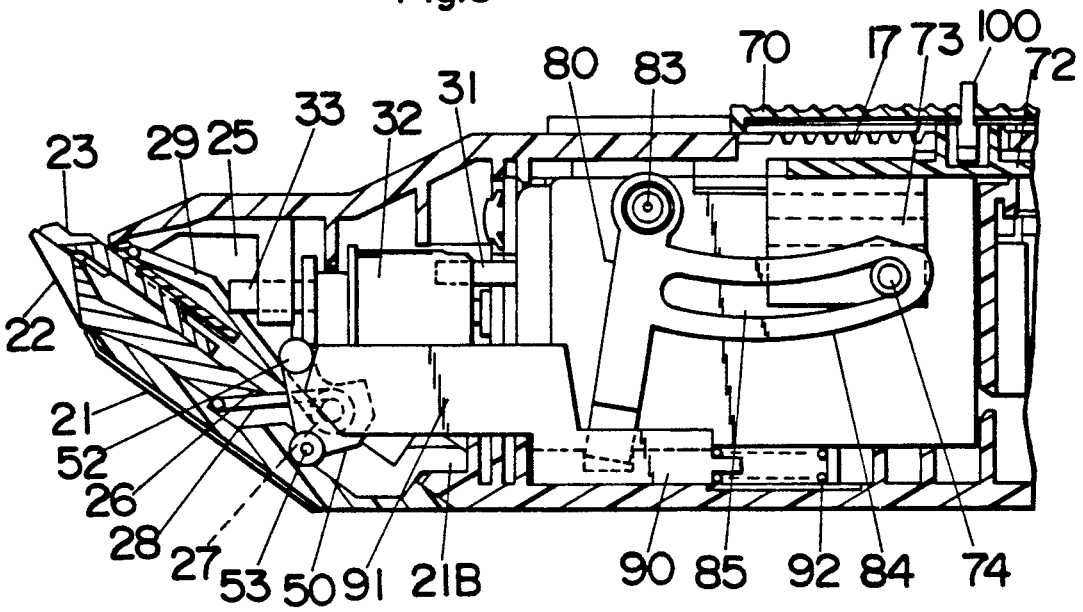
FIG. 6 is a vertical section of the hair clipper with the movable blade and an adjustor handle in an extended position.
Figure 8:
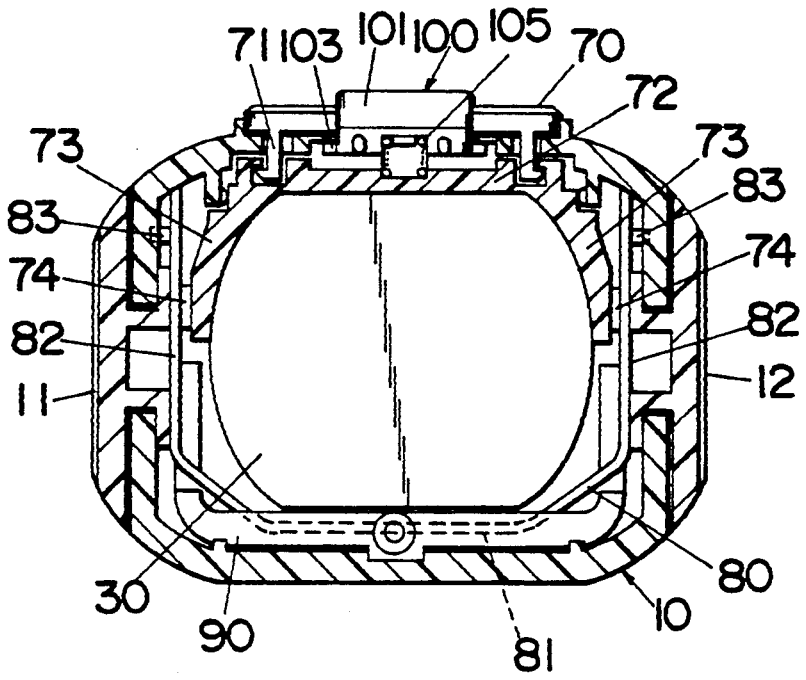
FIG. 8 is a sectional view taken along line 8—8 of FIG. 5.

A cut length adjustor handle 70 is slidably received in a top shallow recess 13 in the upper wall of the housing and defined between parallel rails 14. The handle 70 is knurled on its outer surface to facilitate manual operation by the finger of the operator. As best shown in FIG. 8, the handle 70 is connected by means of hooks 71 to a slider 72 which straddles over the upper half portion of the motor to be slidable within the housing 10. The slider 72 is of a generally U-shaped configuration having opposed legs 73 with outwardly projecting posts 74 by which the slider 72 is linked through a cradle member 80 to an effector plate 90 also slidable on the inner bottom of the housing 10. The cradle member 80 is of a generally U-shaped configuration with a pair of levers 82 extending from opposite ends of a web 81, and is pivotally supported within the housing 10 with pivot pins 83 at the upper ends of the levers 82 connected to the inner upper end portions of the housing be. The web 81 is engaged into a notch in the upper surface of the effector plate 90 so as to move the effector plate 90 back and forth along the lengthwise direction of the housing 10 by the pivotal movement of the cradle member 80 about the pivot pin 83. Integrally projecting rearwardly from each one of the lever 82 is an arcuate member 84 with an arcuate slot 85, as shown in FIGS. 5 and 6, into which the post 84 of the slider 72 extend. It is this slot 85 within which the corresponding post 74 moves as the adjustor handle 70 is manipulated to move back and forth, thereby causing the cradle member 80 to pivot about the pivot pin 83 and therefore moving the effector plate 90 back and forth in the lengthwise direction of the housing be. FIG. 5 illustrates the adjustor handle 70 in its forwardmost position with the post 74 engaged at the forward end of the slot 85. As the adjustor handle 70 moves backward, the post 74 moves correspondingly backward within the arcuate slot 85, during which the posts 74 urge the arcuate members 84 upwardly to thereby pivot the cradle lever 82 rearward and therefore move the effector plate 90 rearward. Thus, when the adjustor handle 70 moves to its rearmost position, as shown in FIG. 6, the effector plate 90 moves oppositely to its forwardmost position. When, on the other hand, the adjustor handle 70 is manipulated to move forward, the effector plate 90 is caused to move rearward.

Figure 7A:
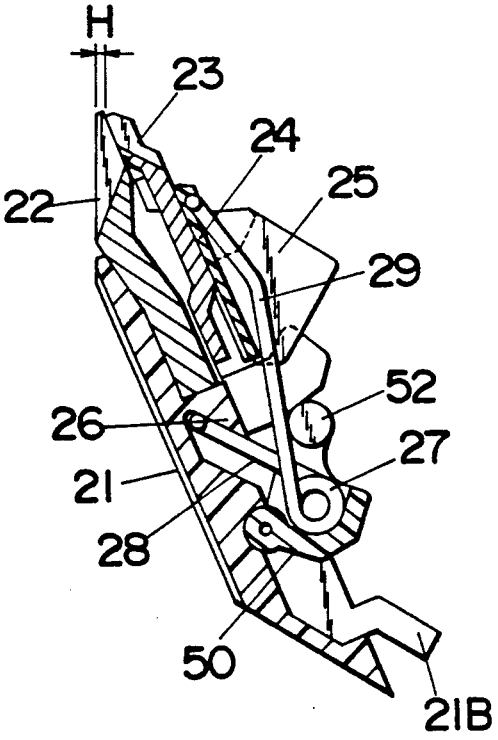
FIGS. 7A and 7B are sectional views of the cutter head with the movable blade shown respectively in the extended and retracted positions.
Figure 7B:
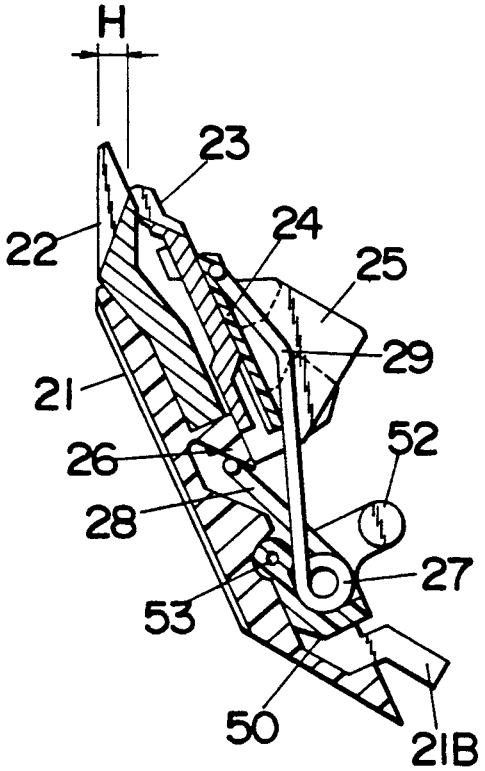
Figure 14:
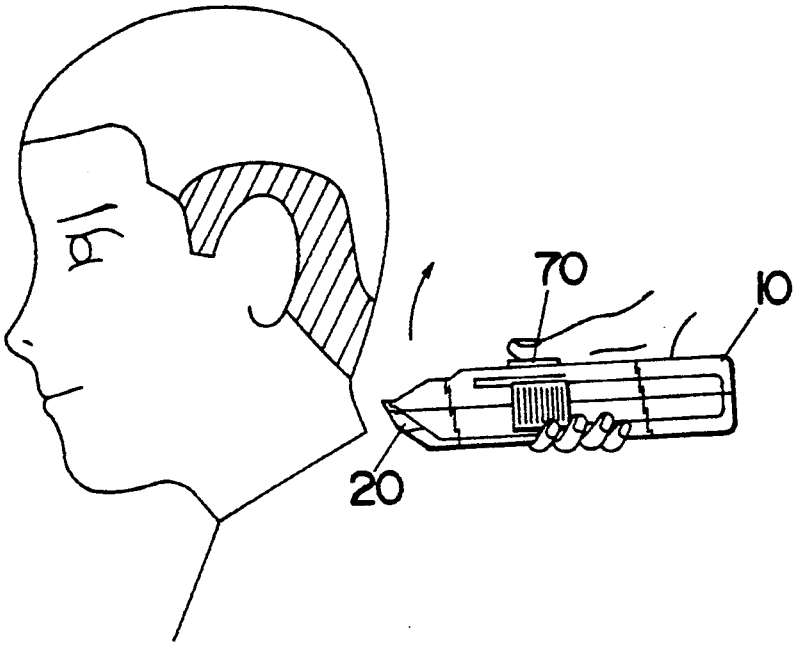
FIGS. 14 and 15 are explanatory views for one typical hair cutting operations effected on a hatched area at the nape and sides of the head.
Figure 15:
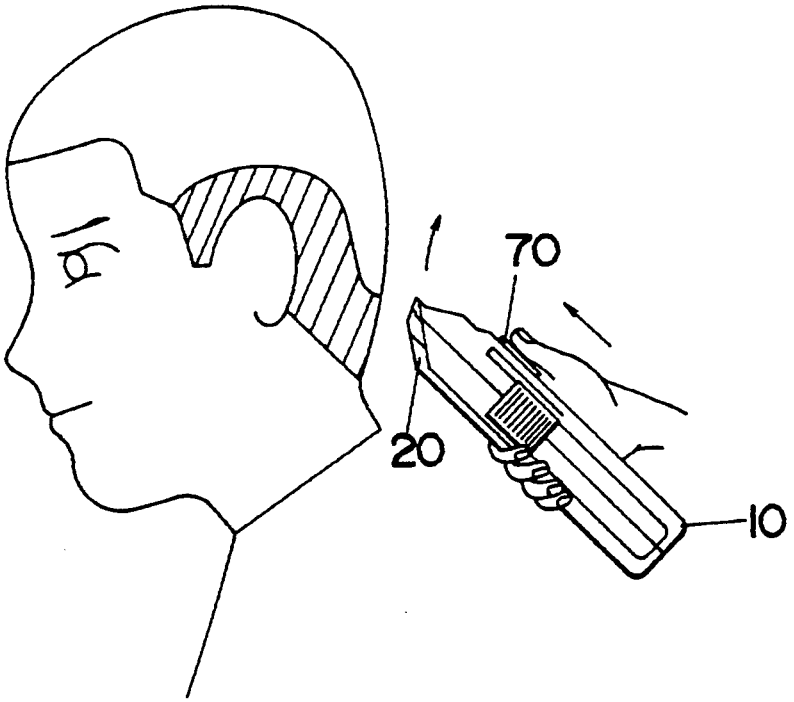

The effector plate 90 is formed integrally with a pair of forwardly extending plungers 91 for abutment against a spring holder 50 at the rear end of the cutter head 20 in such a way as to shift the movable blade 23 forward to an extended position of FIGS. 6 and 7A and rearward to a retracted position of FIGS. 5 and 7B as the effector plate 90 moves forward and rearward, respectively. The spring holder 50 is provided to support a torsion spring 27 with first and second segments 28 and 29 extending from a coiled portion of the spring 27. The spring holder 50 comprises a rod section extending transversely of the base plate 21 of the cutter head 20 and a pair of actuator levers 52 extending radially from the opposite ends of the rod section. The rod section is formed with a recess constraining therein the coiled portion of the torsion spring 27 so that the first and second segments 28 and 29 extend forwardly from the spring holder 50. The spring holder 50 is pivotally supported to the base plate 21 of the cutter head 20 at 53 on the opposite ends of the rod section and offset forwardly from a center axis of the torsion spring 27 such that the spring holder 50 can pivot together with the coiled portion about a pivot axis 53. The first segment 28 has its outer end engaged with a stop 26 forwardly of the spring holder 50 in such a manner as to compress the spring 27 and therefore bias the second segment 29 in the direction of liberating the compression. Whereby, the drive element 24 to which the outer end of the second segment 29 is connected is urged together with the movable blade 23 against the stationary blade 21 in order to obtain a suitable spring bias between the blades during the hair shearing reciprocating movement of the movable blade 23. At the same time, the torsion spring 27 gives a bias to pivot the spring holder 50 in the clockwise direction, as viewed in FIG. 5, about the pivot axis 53 until the spring holder 50 abuts against the bottom of the base plate 21, at which condition the second segment 29 pulls rearward the drive element 24 and the movable blade 23 to the retracted position of FIG. 5 and FIG. 7B. This position provides an increased height H from the skin engaging surface of the stationary blade 22 to the toothed edge of the movable blade 23, thereby minimizing the length of the hairs to be sheared between the stationary and movable blades 22 and 23. At this retracted position of the movable blade 23, the effector plate 90 is at its rearmost position with the adjustor handle 70 in the forwardmost position, as shown in FIG. 5. As the adjustor handle 70 moves rearward to shift the effector plate 90 forward from the position of FIG. 5, the plungers 51 (see FIG. 13) push the actuator levers 52 forward so as to pivot the spring holder 50 in the counterclockwise direction against the bias of the torsion spring 27, thereby displacing the torsion spring 27 forwardly and therefore the movable blade 23 forwardly toward an extended position of FIG. 6 and FIG. 7A, where the toothed edge of the movable blade 23 is spaced from the skin engaging surface of the stationary blade 22 by a minimum height H for effecting a close cut or maximizing the length of the hairs to be sheared. The effector plate 90 is urged forwardly by a spring 92 which counteract the torsion spring 27 so as to reduce a required force for manipulating the handle 70 in the direction of shifting the movable blade 23 toward its extended position on one hand, and to reduce a force acting on the handle 70 from the torsion spring 27 to move the effector plate 90 rearward, i.e., the handle 70 forward on the other hand. In this manner, the sliding movement of the adjustor handle 70 causes the movable blade 23 to shift in the edgewise direction for continuously varying the cut length with the forward movement of the handle 70 coincident with the direction of reducing the cut length. Therefore, it is readily possible to effect a tapered cut on the back and side portion of the head, as indicated by shaded area in FIGS. 14 and 15, firstly by keeping the adjustor handle 70 at the rearward position to make a close cut and then by pushing the handle 70 forward to reduce the cut length in synchronism with the operation of advancing the cutter head 20 upward.

Figure 10A:
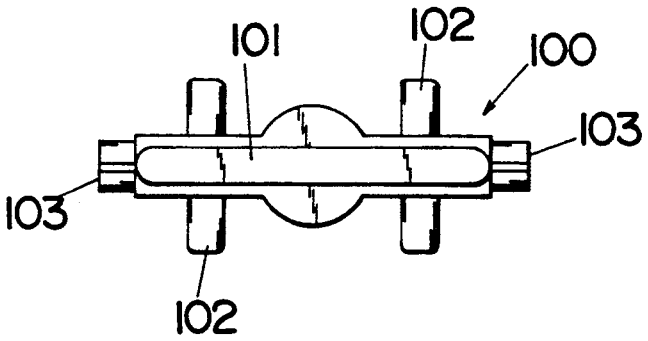
FIGS. 10A to 10C are respectively top, front, and side views of a latch member utilized in combination with the handle of the hair clipper.
Figure 10B:
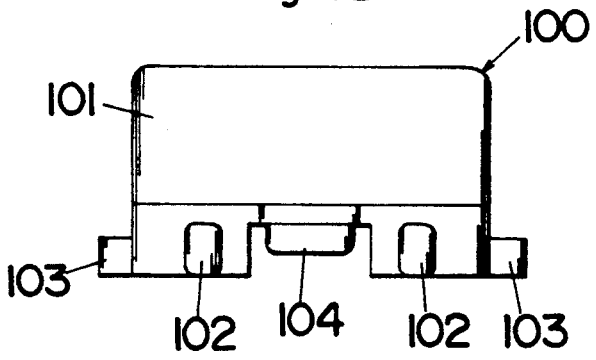
Figure 10C:
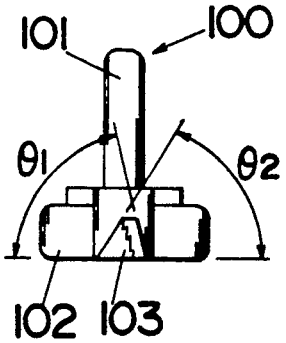
Figure 13:
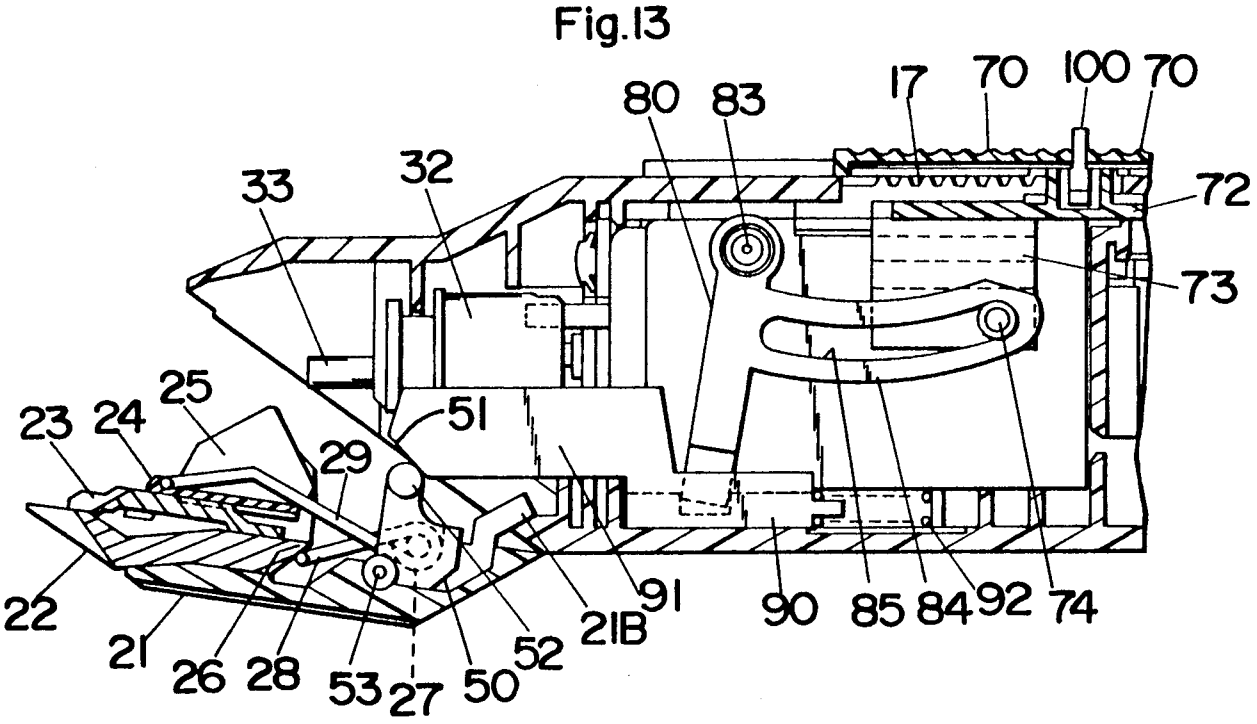
FIG. 13 is a vertical section of a front portion of the hair clipper with the cutter head detached from the housing.

The adjustor handle 70 carries a latch member 100 which, as shown in FIG. 10A to 10C, comprises a plate 101 with pairs of tabs 102 projecting from the lower ends of the plate 101 within the length thereof, a pair of cam projections 103 projecting from the lower ends at the longitudinal ends of the plate, and a boss 104 on the bottom center of plate 101. The latch member 100 is assembled to the handle 70 with the plate 101 projecting on the longitudinal center of the handle 70 to define a release knob which is immediately accessible by a finger of the operator manipulating the handle 70 for adjusting the cut length. The release knob or the plate 101 is biased upwardly by a spring 105 held between the slider 72 and the boss 104 for constant meshing engagement of the cam projections 103 with corresponding teeth of racks 17 formed in the inner top wall of the housing 10, as shown in FIGS. 5 and 6, to latch the handle 70 at any position for setting a desired cut length. In order to adjust the cut length, the operator is only required to press the release knob 101 by the finger to disengage the cam projections 103 from the racks 17 immediately followed by sliding the handle 70 by the same finger to a desired position, after which the handle 70 is latched again upon release of the finger from the release knob 101. In this manner, the handle 70 can be easily moved to any desired position and latched thereat for preventing unintended variations in the cut length during the hair shearing operation. As shown in FIG. 10C, the cam projection 103 are configured to have two inclined edges for meshing engagement with correspondingly shaped tooth of the rack 17 such that when a force is applied to forcibly move the handle 70 in the direction of varying the cut length without positively pressing the release knob 101, the cam projection 103 are caused to slip at the inclined edge relative to the corresponding inclined edge of the teeth of the rack 17, thereby displacing the latch member 100 down against the bias of the spring 105 to disengage the cam projection 103 from the rack and therefore allowing the handle 70 to move in the direction of varying the cut length, while preventing the latching mechanism from being damaged. It should be noted in this connection that rearwardly oriented one of the inclined edge of the cam projection is at a greater angle $\theta_1$ than that $\theta_2$ of the forwardly oriented one with respect to a horizontal plane, as seen in FIG. 10C, such that the handle 70 receives a greater resistance when moving rearward in order to increase the cut length than moving forward in order to reduce the cut length. With this increased resistance, the operator can be well confirmed of one's operation of moving the handle 70 in the direction of increasing the cut length, assuring to avoid cutting the hairs excessively by mistake. In the opposite sense, the handle can be easily manipulated to move smoothly in the direction of reducing the cut length even without pressing down the release knob 101. It may be effective to give a clicking movement to the handle 70 by engaging a portion of the cam projection 103 to the rack 17 even when the release knob 101 is pressed. As shown in FIG. 13, the cutter head 20 can be detached by disengaging a hook 21B from a corresponding recess in the lower front end of the housing 10 for cleaning purposes.

Figure 16:
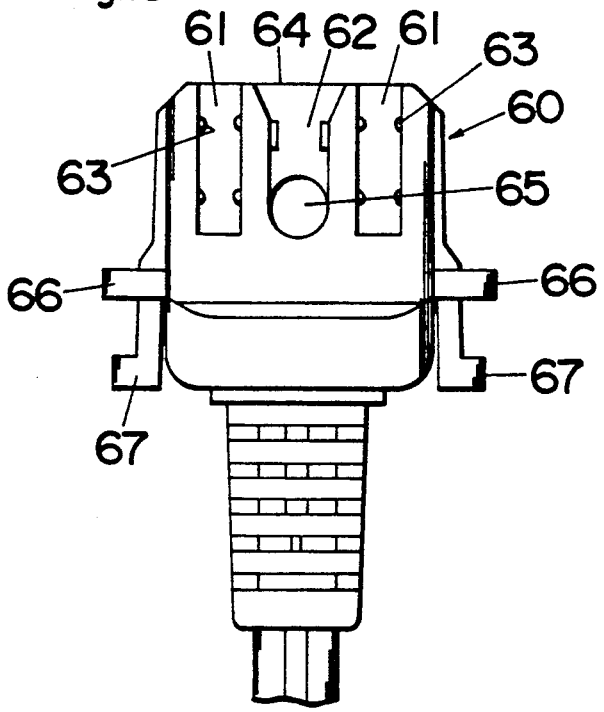
FIG. 16 is a top view of a connector plug for connection into the rear end of the clipper housing.
Figure 17A:
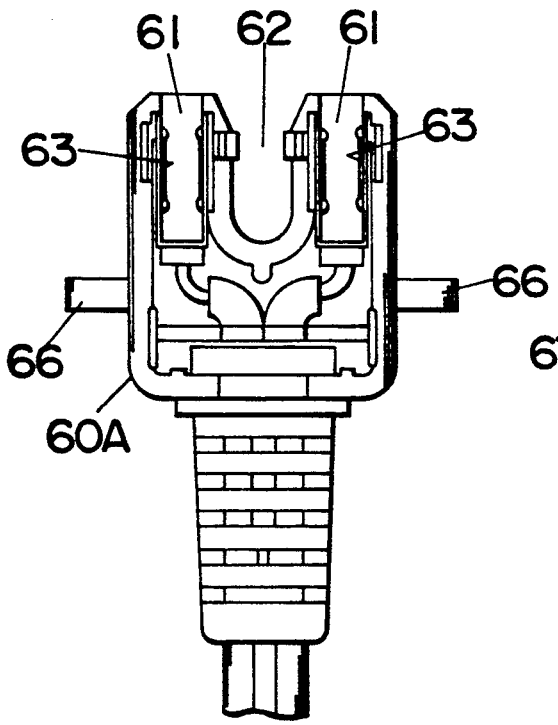
FIGS. 17A and 17B are views showing different parts of the plug.
Figure 17B:
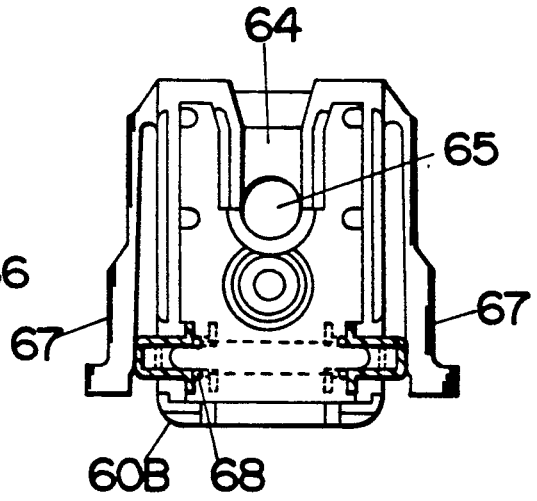
Figure 18:
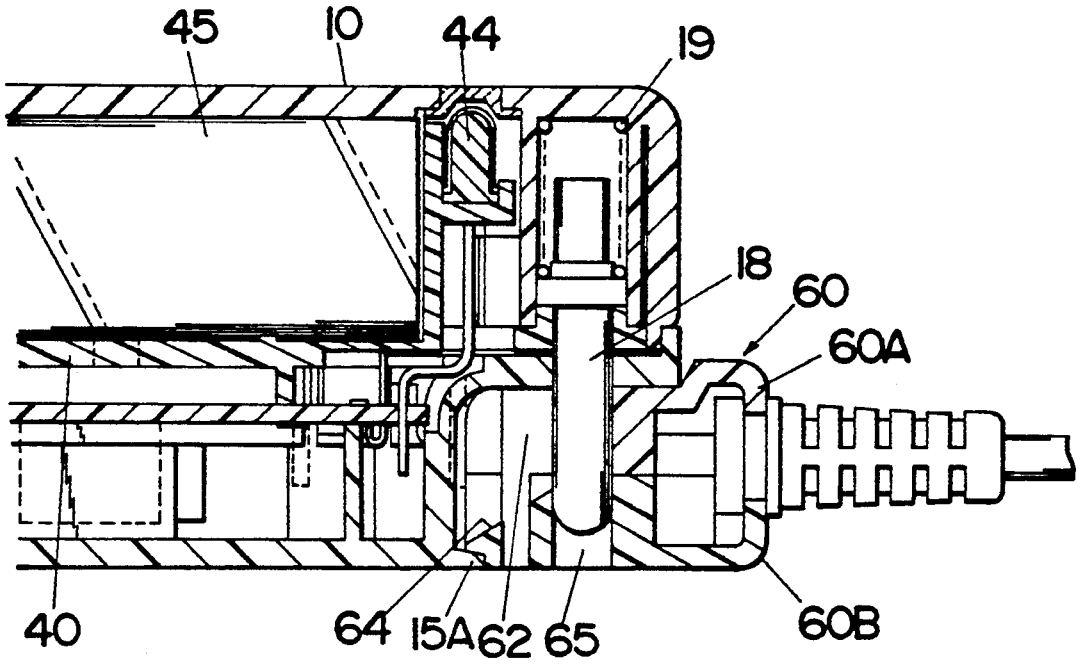
FIGS. 18 and 19 are a vertical section and a plan view respectively of a rear end of the clipper with the plug connected thereto.
Figure 19:
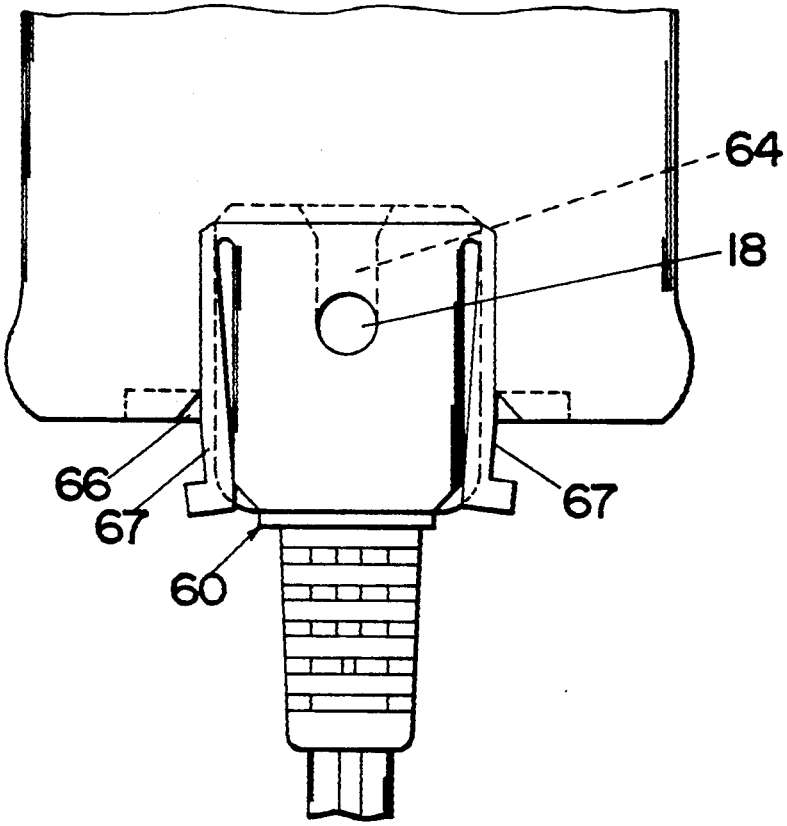
Figure 20:
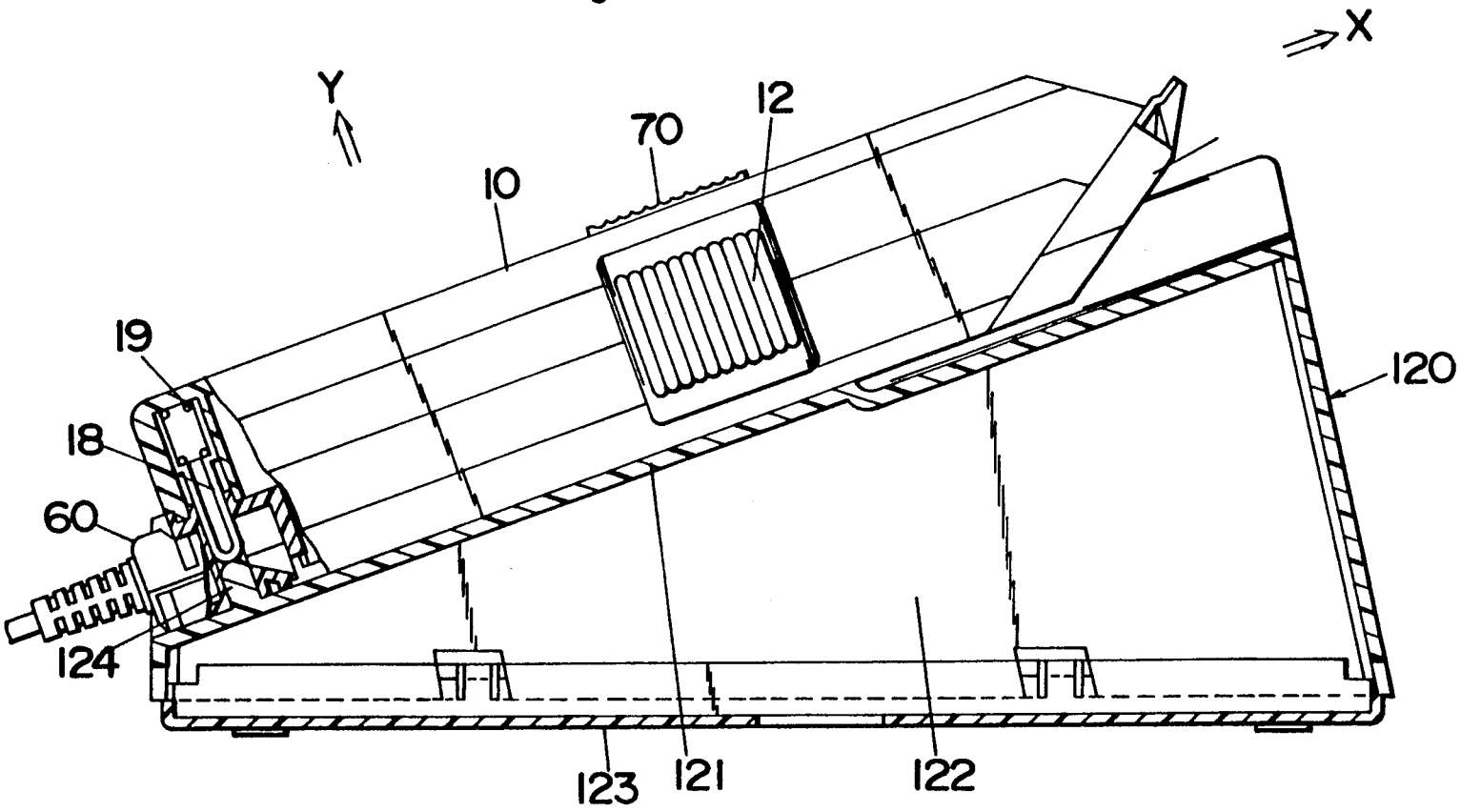
FIG. 20 is a side view, partly in section, of the clipper placed on a stand with the plug connected thereto.
Figure 21:
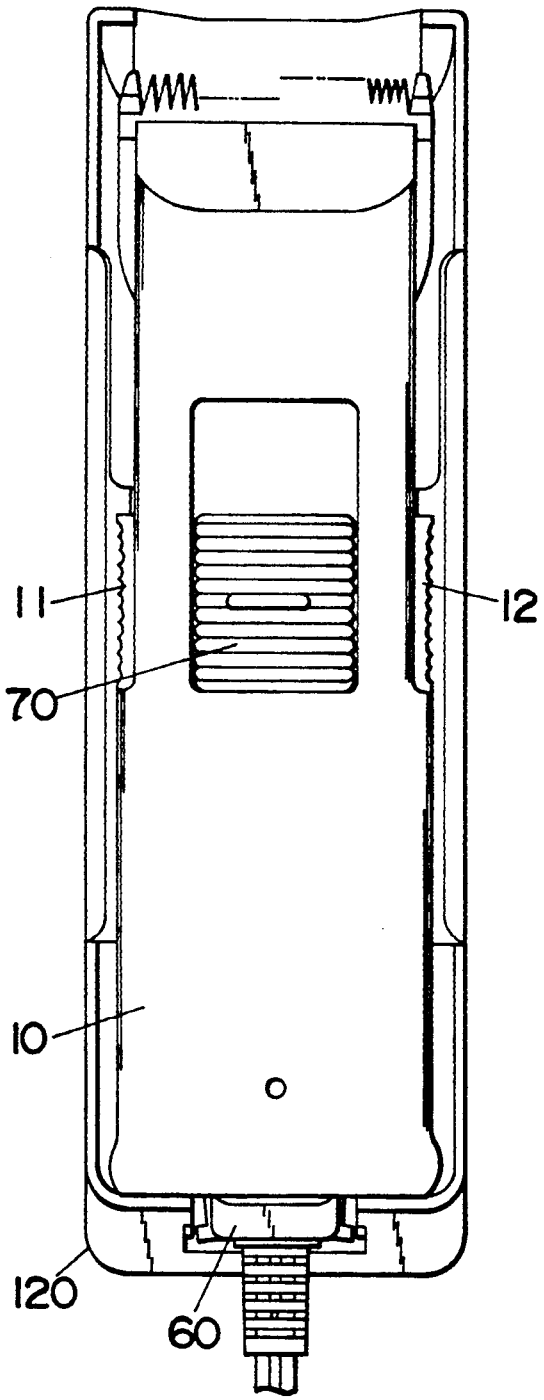
FIG. 21 is a top view of the clipper placed on the stand.
Figure 22:
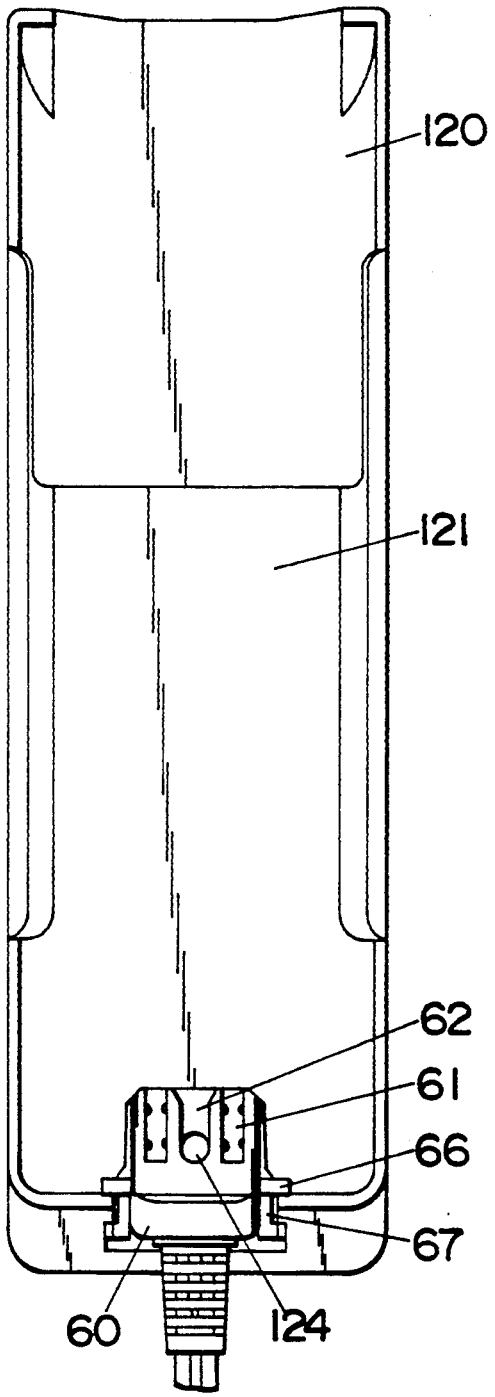
FIG. 22 is a top view of the stand with the plug held thereon.

As shown in FIGS. 16 and 17A and 17B, the plug 60 of the power cord has a pair of side slots 61 on the opposite sides of a center slot 62. Exposed into the side slots 61 are individual electrodes 63 for contact with the terminal springs 43 when the plug 60 is inserted into the socket 15 at the rear end of the housing 10. The center slot 62 has an inclined bottom 64 with a catch hole 65 in its rear end for receiving a lock pin 18 urged by a spring 19 to project into the socket 15. As shown in FIGS. 17A and 17B, the plug 60 is composed of a main body 60A and a bottom cover 60B. The main body 60A is provided with the side slots 61, the electrodes 63, and a pair of sidewardly projecting fins 66, while the cover 6OB is formed with the inclined bottom 64, the catch hole 65, and a pair of flexible legs 67 urged outwardly by a spring 68. The plug 60 is inserted in the socket 15 of the housing 10 until the front end of the plug 60 is engaged with a tab 15A at inner bottom end of the socket 15, as shown in FIG. 18, during which the end of the lock pin 18 is guided along the inclined bottom 64 of the center slot 62 to fall into the catch hole 65 for locking the plug 60 in the socket 15. At this condition, the fins 68 on the opposite side of the plug 60 are engaged into corresponding cavities 15B in the upper sidewalls of the socket 15, as shown in FIGS. 3 and 19, while at the same time the flexible legs 67 are resiliently deformed inwardly to be in pressed engagement with the side walls of the socket 15, as shown in FIG. 19. In order to unlock the plug 60 from the socket 15, there is provided a table 120 having, as shown in FIG. 20, an inclined support surface 121 on which the hair clipper is placed and further including a compartment 122 with a bottom lid 123 for accommodating therein the power cord when out of use. The inclined support surface 121 is formed on its lower end with a stud 124 which projects into the catch hole 65 from the bottom so as to push back the lock pin 18 upwardly against the bias of the spring 19 for disengaging the lock pin 18 from the plug 60 but retaining the plug 60 on the table 120. At this condition, the plug 60 is still retained in the socket 15 by means of the fins 66 and the legs 67. Therefore, the hair clipper can be detached from the plug 60 by being pulled along the inclined support surface 121 in a direction, as indicated by an arrow X in FIG. 20, during which the fins 66 and the legs 67 are slipped out of the socket 15. Then, the hair clipper can be operated in a cordless mode of energizing the motor 30 by the incorporated rechargeable batteries 45, while leaving the plug 60 on the table 120, as shown in FIG. 22. When, on the other hand, the hair clipper is lifted upwardly, as indicated by an arrow Y in the figure, the plug 60 is kept connected to the socket 15 for operation at a normal mode of energizing the hair clipper by an AC power supply through the power cord. In this manner, the mode of energizing the hair clipper can be selected simply by selecting the directions in which the hair clipper is taken out of the table 120.

Figure 23:
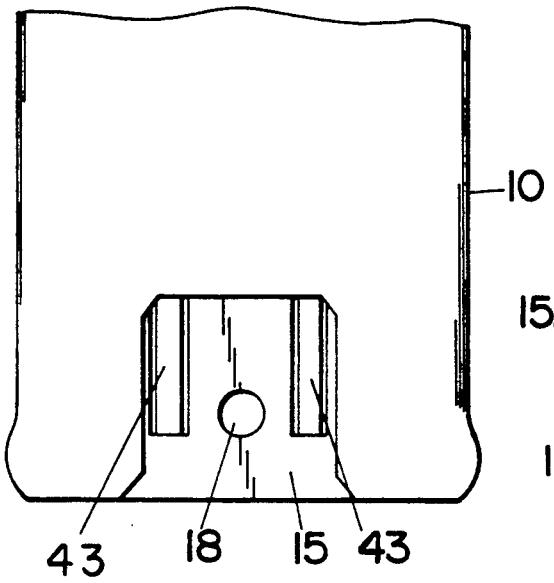
Figure 24:
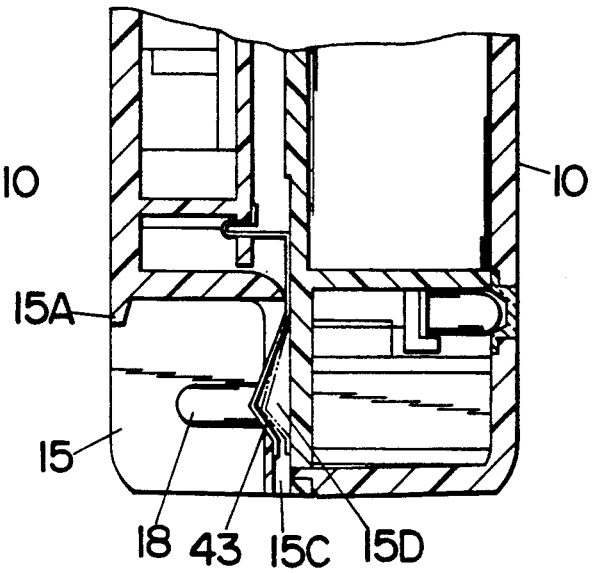
Figure 25:
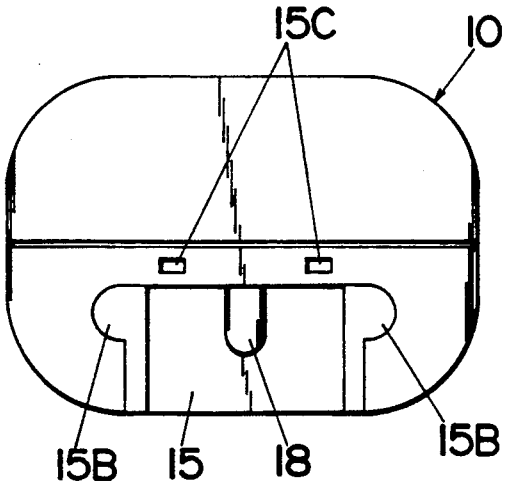

As shown in FIGS. 23 to 25, escape holes 15C may be provided in the rear end of the housing 10 in communication with recesses 15D which are formed in the upper wall of the socket 15 to receive the terminal springs 43 for contact with the electrodes of the plug 60. With the provision of the escape holes 15C, the clipped hairs which may enter the recesses 15D can be expelled outwardly through the escape holes 15C, preventing the terminal springs 43 from being jammed by the clipped hairs.

Figure 26:
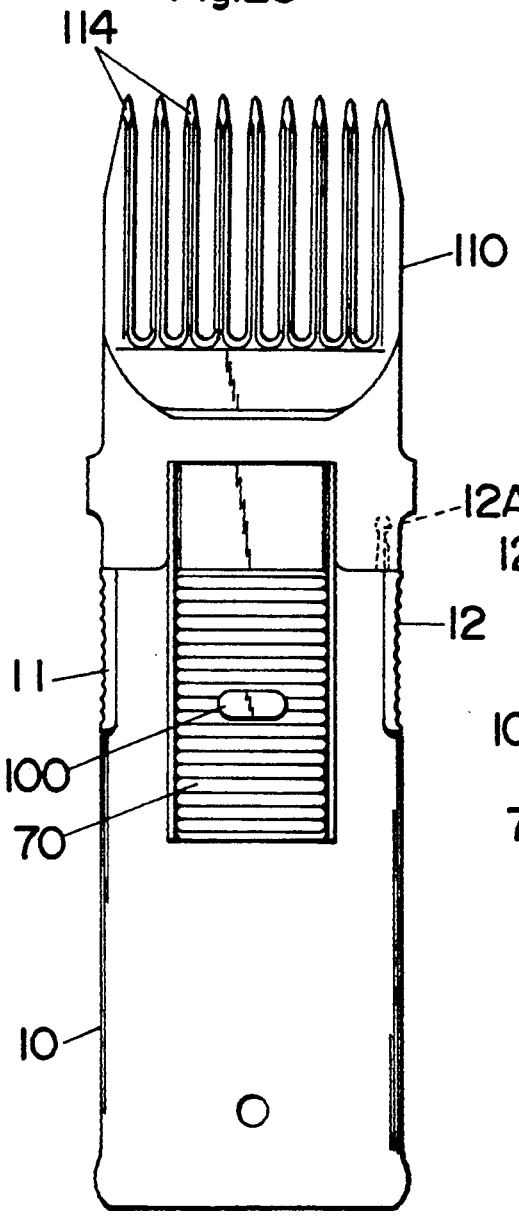
FIGS. 26 to 28 are respectively top and side views of the hair clipper with a comb attachment fitted on the front end thereof.
Figure 27:
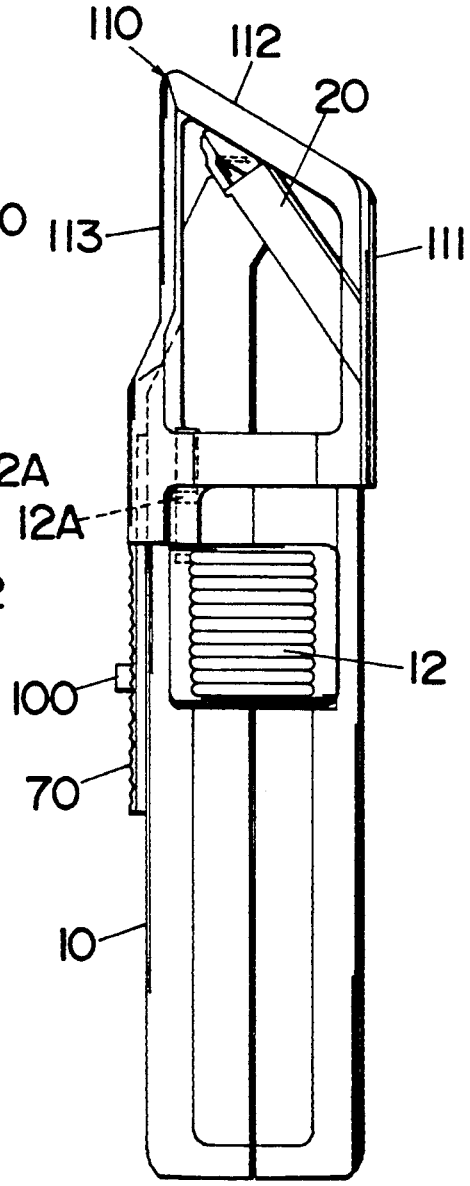
Figure 28:
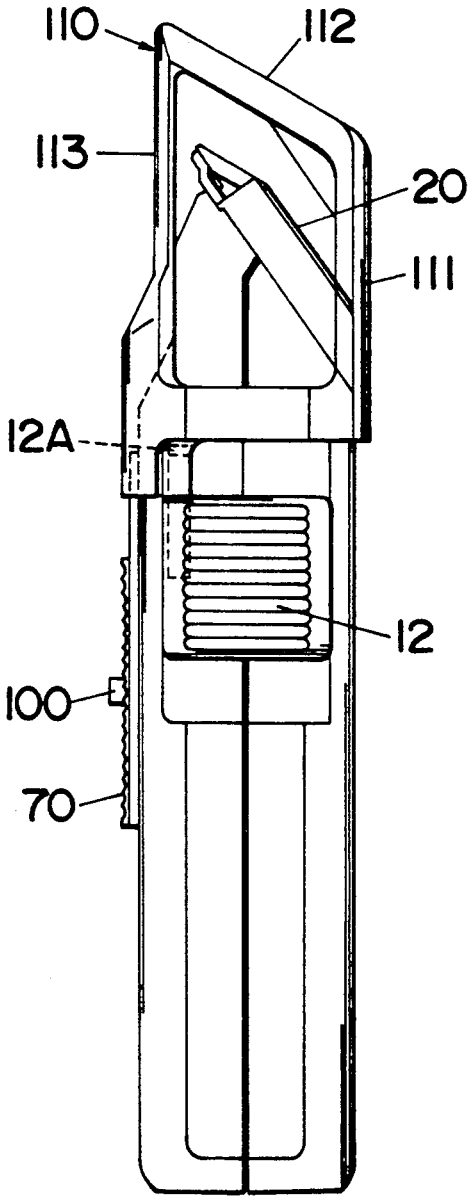

As shown in FIGS. 26 to 28, the comb attachment 110 is slidably fitted over the front end of the housing 10 to be movable in the longitudinal direction thereof. The comb attachment 110 is shaped into a cap-like configuration with a rear opening into which the front end of the housing 10 fits. The front portion of the comb attachment 110 has a flat bottom surface 111, an inclined front surface 112, and a top surface 113, which portions are slotted to form a number of comb fins 114 spaced evenly along the cutting edge of the cutter head 20 at a distance greater than the pitch of the stationary and movable blades 22 and 23. In use, the inclined front surface 112 is brought into guiding contact with the scalp of the user to keep the cutting edge at a fixed distance from the scalp, thereby assuring to cut the hairs to a predetermined length while advancing the cutting edge across the skin surface, during which the hairs are smoothed by the comb fins 114 prior to reaching the cutting edge for successfully cutting twisted, entangled, or flattened hairs. Since the comb attachment 110 is slidable along the length of the housing 10, it is easy to vary the distance between the inclined top surface and the cutting edge for adjustment of the cutting length of the hair. To this end, the comb handle 12 is connected to the comb attachment 110 at a hook 12A so as to adjust the distance by the sliding the handle 12 along the side of the clipper housing 10.

What is claimed is:

1. A hair clipper comprising:

a housing having a rearward end and an opposed forward end with a cutter head including a stationary blade with a toothed leading edge and a moveable blade with a toothed leading edge mounted for reciprocation in a reciprocation direction with said toothed leading edges overlapping in a hair shearing relationship;

said stationary blade having an outer scalp engaging surface and an inner surface facing toward said moveable blade;

the outer surface of said stationary blade along its leading edge being inclined relative to said inner surface so as to produce a shorter length of hair which is cut when there is a lesser amount of overlap in said hair shearing relationship;

at least one of said stationary blade and said moveable blade being a longitudinally moveable blade mounted for movement in a direction generally perpendicular to said reciprocation direction so as to adjust a cut length of hairs sheared between said blades;

an adjustor handle mounted on said housing for generally longitudinal movement thereon toward and away from said cutter head;

linkage means between said longitudinally moveable blade and said adjustor handle for moving said longitudinally moveable blade in a rearward direction to decrease said length of hair which is cut when said adjustor handle is moved forward toward said cutter head.

2. The hair clipper of claim 1 in which said longitudinally moveable blade is said moveable blade.

3. The hair clipper of claim 1 including a latch means for latching said adjustor handle in position and a release knob projecting on a portion of said adjustor handle to be accessible by a finger of the user, said release knob acting to unlatch said adjustor handle upon being pressed inwardly, thus permitting slidable movement thereof.

4. The hair clipper as set forth in claim 3, wherein said latch means comprises a rack formed on the housing and a toothed member on the part of said handle which are in meshing engagement with each other in such a manner as to provide a greater latching force when moving said handle in a direction of increasing said cut length than moving said handle in the opposite direction of reducing said cut length.

5. A hair clipper as set forth in claim 3, wherein said stationary and movable blades define therebetween a cutting plane which is inclined with respect to a general plane including an upper wall of said housing on which said handle is mounted, said housing provided on opposite side walls thereof respectively with a power switch handle and a comb handle linked to a comb attachment which is fitted over said cutter head for combing the hairs into said stationary and movable blades and is formed with a slotted edge arranged in parallel with said toothed edge of said stationary blade, said comb handle actuating said comb attachment for varying the distance between said slotted edge of said comb attachment and said toothed edge of said stationary blade.

* * * * *